US010948232B2

(12) United States Patent
Niklaus

(10) Patent No.: US 10,948,232 B2
(45) Date of Patent: Mar. 16, 2021

(54) TEXTILE FIBER DRYING

(71) Applicant: AUTEFA SOLUTIONS GERMANY GMBH, Friedberg (DE)

(72) Inventor: Michael Niklaus, Seuzach (CH)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 96 days.

(21) Appl. No.: 16/462,711

(22) PCT Filed: Nov. 29, 2017

(86) PCT No.: PCT/EP2017/080807

§ 371 (c)(1),
(2) Date: May 21, 2019

(87) PCT Pub. No.: WO2018/099963

PCT Pub. Date: Jun. 7, 2018

(65) Prior Publication Data

US 2019/0316839 A1 Oct. 17, 2019

(30) Foreign Application Priority Data

Nov. 29, 2016 (DE) ..... 10 2016 122 965.2

(51) Int. Cl.
*F26B 3/08* (2006.01)
*F26B 17/02* (2006.01)
(Continued)

(52) U.S. Cl.
CPC ..... *F26B 3/08* (2013.01); *F26B 17/026* (2013.01); *F26B 17/04* (2013.01); *F26B 21/08* (2013.01); *F26B 21/10* (2013.01)

(58) Field of Classification Search
CPC .. F26B 3/08; F26B 17/04; F26B 21/10; F26B 17/026; F26B 21/08; F26B 13/101; F26B 3/06; F26B 17/00; D06C 7/00
(Continued)

(56) References Cited

U.S. PATENT DOCUMENTS 1,476,424 A * 12/1923 Sargent ..... F26B 17/026 34/203
1,778,318 A * 10/1930 Haas ..... F26B 17/04 34/223
(Continued)

FOREIGN PATENT DOCUMENTS

CH 221 858 A 6/1942
CH 360655 A 2/1962
(Continued)

*Primary Examiner* — Edelmira Bosques
*Assistant Examiner* — Bao D Nguyen
(74) *Attorney, Agent, or Firm* — McGlew and Tuttle, P.C.

(57) ABSTRACT

A method and a fiber-treatment system dry wet or damp fibers. A fiber mat (13) including wet or damp fibers is formed on a treatment band (31) which is moved in a conveying direction (x). An air flow (36, 36*a*) composed of heated drying air is generated in the fiber dryer (30). The heated drying air is guided in an upward direction through the treatment band and the fibers contained in the fibre mat (13, 14) are loosened and dried. Linters (16) possibly produced by any moving fibers are captured by a filter band (32) arranged above the treatment band, which is also moved in the conveying direction (x). At the outlet of the fiber dryer, the fibers are detached from a support (17) formed on the filter band, in particular when guiding the detached fibers back towards the dried fibers guided to the treatment band (31, 31*c*).

18 Claims, 3 Drawing Sheets

(51) Int. Cl.
*F26B 17/04* (2006.01)
*F26B 21/08* (2006.01)
*F26B 21/10* (2006.01)

(58) Field of Classification Search
USPC ..... 34/282, 122, 634, 203
See application file for complete search history.

(56) References Cited

U.S. PATENT DOCUMENTS 1,813,750 A * 7/1931 MacKenzie ..... F26B 17/026 34/203
1,919,057 A * 7/1933 Furbush ..... F26B 17/04 34/66
2,010,917 A * 8/1935 Du Pont ..... D21F 5/00 34/230
2,152,939 A * 4/1939 Wentworth ..... F26B 17/026 198/603
2,346,500 A * 4/1944 Moore ..... F26B 3/08 134/25.1
2,838,420 A * 6/1958 Valente ..... F26B 13/103 427/378
2,964,855 A * 12/1960 Fava ..... F26B 17/08 34/203
3,043,018 A * 7/1962 Fleissner ..... F26B 17/288 34/115
3,096,161 A * 7/1963 Morrison ..... D04H 1/00 34/256
3,589,029 A * 6/1971 Fleissner ..... F16B 9/02 34/115
3,685,322 A * 8/1972 Fleissner ..... D01O 5/00 68/2
3,913,241 A * 10/1975 Chaikin ..... F26B 13/101 34/122
411,258 A * 9/1978 Sundman ..... F26B 17/026 34/388
4,290,209 A * 9/1981 Buchanan ..... D21F 1/0036 139/383 A
4,490,927 A * 1/1985 Kissell ..... B29C 70/504 34/207
4,611,989 A * 9/1986 Kersting ..... F26B 3/20 198/495
4,734,996 A * 4/1988 Kim ..... F26B 17/026 34/420
4,811,496 A * 3/1989 Honda ..... F26B 3/20 198/840
4,831,746 A * 5/1989 Kim ..... F26B 17/026 34/111
5,325,606 A * 7/1994 Liborius ..... B01J 8/005 165/104.16
5,527,458 A * 6/1996 Gehrmann ..... B01D 33/04 210/177
5,565,049 A * 10/1996 Simmons ..... B29C 70/508 156/212
5,575,048 A * 11/1996 Ruef ..... D02J 13/006 28/219
5,642,601 A * 7/1997 Thompson, Jr. ..... B65B 63/02 428/921
2001/0017253 A1* 8/2001 Patel ..... D04H 1/70 198/493
2001/0028127 A1* 10/2001 Hinds ..... D06N 3/06 264/126
2002/0088137 A1* 7/2002 Savarese ..... F26B 17/04 34/266
2009/0000144 A1* 1/2009 Berg ..... F26B 25/002 34/218
2012/0151790 A1* 6/2012 Savarese ..... F26B 17/023 34/282
2014/0319721 A1* 10/2014 Celle ..... B29C 67/249 264/128
2015/0190948 A1* 7/2015 Nguyen ..... B29C 35/10 264/463
2016/0369194 A1* 12/2016 Duan ..... C10L 5/04

FOREIGN PATENT DOCUMENTS

| | | | |
|---|---|---|---|
| DE | 544 187 | C | 2/1932 |
| DE | 632 709 | C | 7/1936 |
| DE | 1 604 852 | B | 3/1970 |
| DE | 16 29 008 | A1 | 1/1971 |
| DE | 1 729 264 | A1 | 7/1971 |
| EP | 0 811 141 | A1 | 12/1997 |
| EP | 2 087 159 | B1 | 12/2010 |
| FR | 933 669 | A | 4/1948 |
| FR | 1 132 555 | A | 3/1957 |
| GB | 499 374 | A | 1/1939 |
| GB | 1 182 019 | A | 2/1970 |
| WO | 96/26403 | A1 | 8/1996 |
| WO | 2016/008968 | A2 | 1/2016 |

* cited by examiner

TEXTILE FIBER DRYING

CROSS REFERENCE TO RELATED APPLICATIONS

This application is a United States National Phase Application of International Application PCT/EP2017/080807 filed Nov. 29, 2017, and claims the benefit of priority under 35 U.S.C. § 119 of German Application 10 2016 122 965.2, filed Nov. 29, 2016, the entire contents of which are incorporated herein by reference.

TECHNICAL FIELD

The present invention pertains to a technique for drying damp or wet textile fibers. The present disclosure is directed especially towards a fiber treatment plant for drying damp or wet viscose fibers.

TECHNICAL BACKGROUND

Viscose fibers impose special requirements on a drying process because they tend to undergo compaction and mutual adhesion in the wet state, on the one hand, and because they tend to generate fly (also known as fiber fly or airborne fiber) in the half-dry or dry state, on the other hand.

The "drying of fibers" is defined within the framework of the present disclosure as the drying of fibers that are arranged in an essentially tangled or free form in a mixture with a liquid. Because of the absence of a macrostructure, there are no or only minimal bonds between the individual fibers. The fibers may especially be textile fibers that are dried subsequent to a production or washing process.

The fiber drying technique discussed within the framework of the present disclosure should consequently be distinguished from drying techniques for fibrous webs, nonwovens, fabrics and similar textiles.

Prior-art fiber drying plants, for example, those according to DE 1 729 264 A, use a heated air stream for drying the fibers, which is directed from the top downwards through a quantity of fibers. Such an air stream holds the fibers to be dried reliably on an air-permeable support, so that fly is essentially avoided or its quantity is limited. However, the downwardly directed air stream leads to various drawbacks. On the one hand, the damp fibers are compressed towards the support by the relative overpressure above the fibers and are thus compacted. The effective surface of the fibers that can be utilized for the drying decreases due to the compaction, so that the drying capacity is impaired. The fibers are optionally opened in the prior-art dryers between separate drying operations, for which special devices are necessary. On the other hand, the permeability to air of the fibers to be dried is reduced by the downwardly directed air stream and by the compression, so that layers located in the vicinity of the support are dried only slowly. Inhomogeneous distributions of zones with high and low permeability to air may also develop, which is likewise disadvantageous for the result of the drying.

Furthermore, fiber drying plants in which the fibers are clamped between a lower conveyor belt and a cover belt during the drying process are known as well. The fibers are compressed between the belts and are not consequently loosened sufficiently. The fibers are likewise not dried optimally as a result.

A blowing device, which generates an air stream directed upwardly from the bottom in order to separate an at least partially strengthened fiber product from a belt, is known from EP 2 087 159 B1. No fly is generated because of the at least partial strengthening.

WO 2016/008968 A2 discloses a thermobonding oven, in which an air stream directed from bottom to top is sent through a fibrous web, which contains at least a certain percentage of thermoplastic fibers. The fibers in the fibrous web have a macrostructure, which binds the fibers at least partially and prevents fly. Additional bonding points are produced between the fibers by the at least local melting of the thermoplastic fibers.

SUMMARY

An object of the present invention is to provide an improved technology for drying wet or damp fibers, especially for drying viscose fibers.

The present disclosure comprises a drying process for drying damp or wet textile fibers, especially for drying viscose fibers. The drying process is, furthermore, suitable for drying fibers that are produced in a solvent spinning process or in a wet spinning process. Such fibers are washed, as a rule, after the spinning process in order to remove the solvent or other undesired chemical substances from the fibers. A considerable percentage of water or of a washing liquid remains in and/or between the fibers after the washing. It is also possible to dry fibers that are in the form of wet or damp fibers following a bleaching or dyeing process and possibly after a subsequent washing according to the present drying process.

The drying process according to the present disclosure preferably comprises the following steps. A fiber mat is formed from the wet or damp fibers on an air-permeable treatment belt. The treatment belt can be moved in a conveying direction through a fiber dryer, which is encapsulated in an essentially air-tight manner towards the outside and it preferably comprises an air circulating system for providing a drying air.

An air stream of a heated drying air is generated in the fiber dryer. The air stream is sent through a flat drying zone section of the treatment belt in the upward direction, and the fibers contained in the fiber mat are loosened and dried by the drying air or the air stream.

Compression of the fibers on the treatment belt is avoided by the upwardly directed air stream, because a relative vacuum prevails above the fibers. The effective surface of the fibers that is available for the drying is not consequently reduced, and the drying efficiency of the fibers is not compromised. It is rather possible to advantageously achieve an enlargement of the effective surface, while the volume density of the fiber mat is reduced. In other words, the mass to be dried expands under the effect of the air stream, so that the permeability to air is increased and an inner adhesion between the fibers is avoided.

Fly may be generated by the upwardly directed air stream, i.e., individual fibers or small fiber flocks may become separated from the mass being dried and carried away upwards according to the orientation of the air stream. Provisions are made in the drying process according to the present disclosure for the fibers being moved by fly in the air stream to be captured by a filter belt arranged above the treatment belt, this filter belt being likewise moved in the conveying direction. A relative overpressure prevails under the filter belt, so that the majority of the fibers being moved by fly adhere to the filter belt and form a deposit there.

Consequently, fly is deliberately allowed to occur in the drying process to improve the drying efficiency. The percentage of the fibers separated as fly from the mass being dried (especially a fiber mat) may range from a low to a considerably high percentage. A preferably continuous return of the separated fibers to the dried fiber mat is made possible by the capture at the filter belt, so that there is no loss of material or there is only an insignificant loss of material.

The deposit formed from the fibers is preferably separated from the filter belt at the outlet of the fiber dryer, especially with recycling of the separated fibers to the dried fibers lying on the treatment belt. The return may be brought about in any desired manner, preferably by a stripping blower, which blows the separated fibers into a return duct directed towards the treatment belt.

An especially high drying efficiency can be achieved by the above-mentioned process. In particular, the length of the drying section can be reduced by up to 50% compared to comparable plants with downwardly directed air stream. A continuous drying process is made possible due to the movement of both the treatment belt and the filter belt. The filter belt and the treatment belt may be provided each as circulating belts. They are guided preferably within the fiber dryer and encapsulated against the surrounding area such that essentially all the fibers that are separated from the fiber mat by fly are captured via the filter belt, are moved to the outlet of the fiber dryer and are returned there to the rest of the fibers in the fiber mat.

The term air circulating system is defined in the present disclosure as a system which moves a drying air in an essentially circular circulation through the fibers being dried and a heat source. Additional fresh air can be fed to this air circuit and/or used air can be removed from this air circuit in the course of the drying at different points. The air circulating system comprises at least one blower or other air feed devices, which act as air circulating fans and generate the air circuit. Moreover, it may comprise a blower or a plurality of additional blowers or other air feed devices, which act as fresh air feed fans or as used air extractor fans. The air circulating system may generate a plurality of circuits for a plurality of belt sections, especially at least one circuit for a drying section, wherein this plurality of circuits may be connected to one another in such a manner that drying air can be sent from one circuit to the next one. Such a transfer of drying air between the circuits preferably takes place in a controlled or regulated manner.

The present disclosure further comprises a fiber treatment plant for drying damp or wet textile fibers. The fiber treatment plant comprises at least one fiber dryer, which is configured as an outwardly essentially air-tight dryer. The fiber dryer may also be called a continuous drying oven.

The fiber dryer has the air-permeable treatment belt explained above, which can be moved through the fiber dryer in a conveying direction. The conveying direction is preferably oriented horizontally from an intake area of the fiber dryer to a discharge area. The fiber dryer further has a filter belt, which is arranged above the treatment belt and can be moved in the conveying direction.

A (middle) chamber, in which the fly may occur, is formed between a drying zone section of the treatment belt and the filter belt. The chamber is preferably defined by the treatment belt and the filter belt towards the top side and towards the underside. The filter belt is preferably located at a spaced location from the treatment belt in the vertical direction, the distance being greater than the greatest expectable thickness of the dried fiber material. The filter belt is guided above the fiber material being dried in a contactless manner. The fiber mat can be loosened during the drying process and expand freely in the vertical direction due to the distance between the treatment belt and the filter belt. Compression of the fibers between the treatment belt and the filter belt is avoided as a consequence of the distance. The (middle) chamber is encapsulated in an essentially air-tight manner towards the other sides by (inner or outer) walls of the fiber dryer.

The fiber dryer according to the present disclosure comprises an air circulating system, which is configured to generate an air stream from a heated drying air. The air stream is generated such that it flows in an upward direction through the middle chamber and a fiber mat, which can be laid on the treatment belt, so that the fibers in the fiber mat are loosened and dried.

The present invention is schematically shown as an example in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
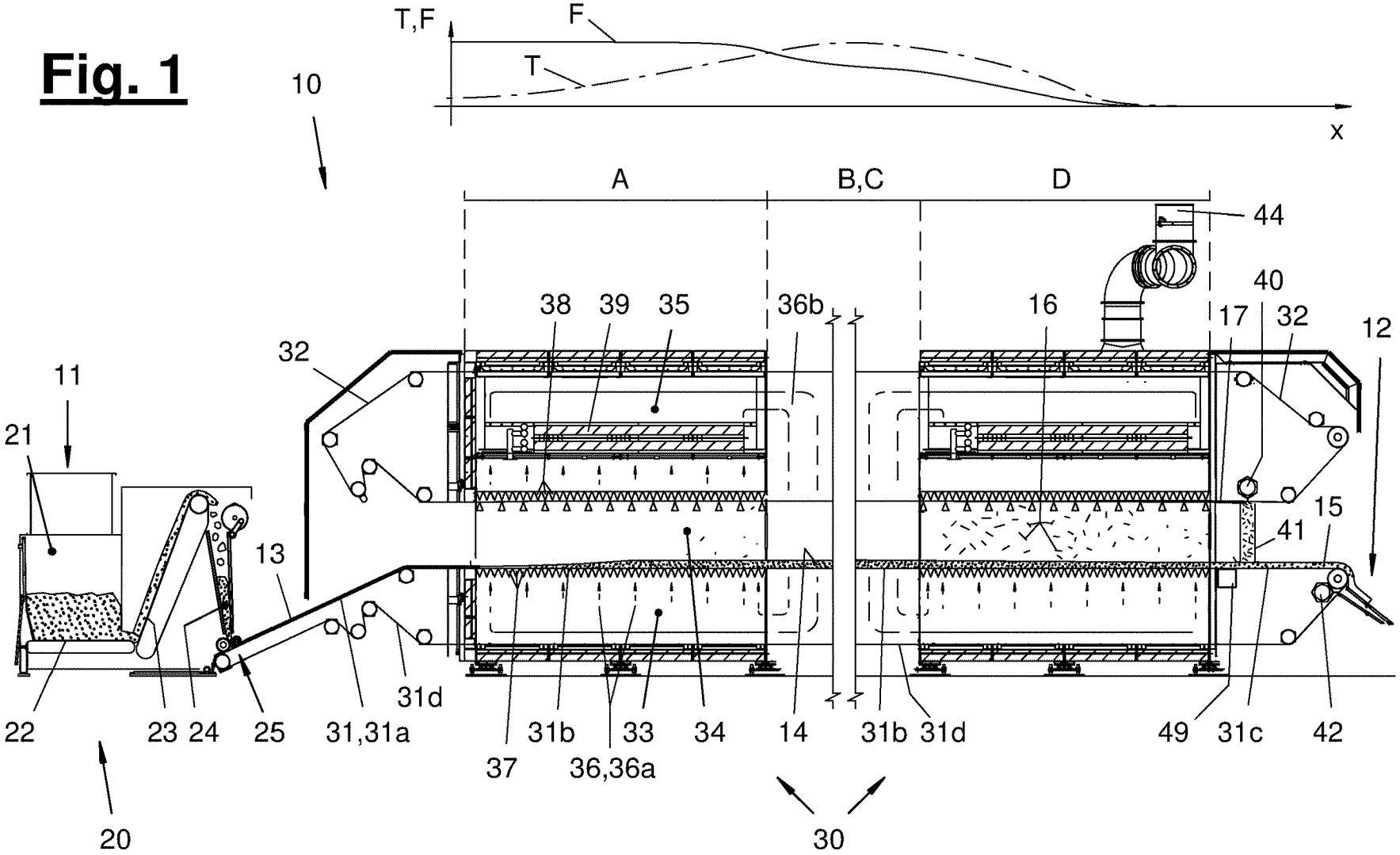
FIG. 1 is a cross sectional view of a fiber treatment plant according to the present disclosure.

Referring to the drawings, FIG. 1 shows a fiber treatment plant (10) with a fiber mat producer (20) and with a fiber dryer (30). A conveying direction (x) extends through the fiber treatment plant (10) from the left side to the right side in FIG. 1.

In the area of a wet fiber feed hopper (11), wet or damp fibers can be fed to the fiber treatment plant (10) in any desired initial form, for example, as bulk material, which can be filled into the feed tub of the fiber mat producer (20). The fiber mat producer (20) shown in FIG. 1 is an exemplary embodiment in the manner of a hopper feeder. As an alternative, any other desired fiber mat producer (20) may be provided, for example, in the form of a feed shaft or of a vibrating shaft feeder. Likewise as an alternative, the fiber treatment plant (10) may be formed without a fiber mat producer (20), for example, if the wet or damp fibers can already be fed as a fiber mat or fiber strand from a working device arranged upstream.

The fiber mat producer (20) according to FIG. 1 has at the bottom of the feed tub (21) a movable lower belt (22), which is movable in the conveying diction (x), in order to feed the wet fibers being fed to an ascending belt (23). The ascending belt (23) may have any desired and suitable configuration, which may depend especially on the type of the material, the degree of wetness or dampness as well as the length of the fibers to be dried. A lattice feed table with a set of needles may preferably be used for damp or wet viscose fibers.

The wet or damp fibers are conveyed by the ascending belt (23) into an elevated position and are already shaped basically into the form of a mat with a more or less uniform cross section. The fibers are conveyed from the elevated position into a compression shaft or vibrating shaft (24). The compression or vibrating shaft (24) may have at least one wall, which is moved to and fro for repeatedly widening or narrowing the width of the shaft. Output rollers (25), which pull off the fiber strand formed in the shaft or the fiber mat and lay it on a conveyor belt guided under it, may preferably be arranged at the lower end of the compression or vibrating shaft (24). The conveyor belt is already a feed section (31*a*) of the treatment belt (31) of the fiber dryer (30) in the example according to FIG. 1. As an alternative, a separate conveyor belt may be provided, which guides the fiber mat to the intake area of the fiber dryer (30).

It will be assumed in a simplified manner below that the mass of fibers to be dried, which is laid on the treatment belt (31), has the shape of a fiber mat. This represents the preferred shape of the mass to be dried. The fiber mat may have an essentially constant width and height especially preferably at the intake area. The width may be, for example, in the range of 1 m to 4 m. The height of the fiber mat may be, for example, 10 mm to 100 mm and depend on the degree of wetness and the type of the fibers to be dried.

The term "fiber mat" will be used below to designate any desired form of placement of the mass to be dried, which comprises fibers and a liquid, i.e., also a form of placement in one or more fiber strands.

The treatment belt (31) is preferably arranged at the fiber dryer (30) as a circulating belt, whose upper run is conveyed in the direction (x) from the intake area of the fiber dryer (3)) through the drying zone to the outlet area. A lower run of the treatment belt (31) is returned to the intake area in the opposite direction. The upper run of the treatment belt (31) will usually be meant when features of the treatment belt (31) or the interaction of other components with the treatment belt (31) are described.

The wet or damp fibers are placed as a fiber mat (13) on the treatment belt (31) in the inlet area or intake area of the fiber dryer (30). The fiber mat (13) has a relatively high volume density (compressed arrangement of the fibers) and a high weight per unit area (weight of the fibers plus weight of the liquid) in the wet or damp state.

During the run through the fiber dryer (30) in the conveying direction (x), moisture is successively removed from the fiber mat (13), and the fibers are loosened as a consequence of the upwardly directed air stream and of the drying operation. As a result, a half-dry and expanded fiber mat (14), which has a markedly lower volume density and a substantially reduced weight per unit area, is correspondingly formed gradually within the fiber dryer (30) from the wet fiber mat (13), because the weight of the mass being dried is gradually reduced to the weight of the fibers due to the removal of the liquid/moisture. The thickness or height of the fiber mat (13, 14) may increase considerably while running through the fiber dryer (30), and the permeability to air of the fiber mat (13, 14) will, as a rule, increase as well. The individual fibers or fiber flocks contained in the fiber mat (13, 14) will consequently move increasingly away from one another, so that ever greater areas of the fiber surface can come directly into contact with the drying air.

The drying process is preferably regulated such that a dry fiber mat (15) is present at the outlet of the fiber dryer (30). The dry fiber mat (15) may be transferred in the area of a dry fiber outlet (12) to a downstream process, for example, a packaging process or a carding process.

An air stream (36, 36*a*), which is generated by a pressure difference between a lower chamber (33), which extends under the drying zone section (31*b*) of the treatment belt (31), and an upper chamber (35), which extends above the filter belt (32), is generated within the fiber dryer (30). The pressure difference is preferably generated by an air circulating system, which heats the drying air, on the one hand, and circulates the drying air in an at least partially circulating stream within the essentially air-tight fiber dryer (30), on the other hand. The drying air can be brought into contact with the mass to be dried several times due to the circulation, and it gradually absorbs moisture in the process.

The drying zone section (31*b*) is a section of the (upper run of the) treatment belt (31), which section is located within the area of the fiber dryer (30) that is encapsulated in an essentially air-tight manner. The term "air-tight" is defined within the framework of the present disclosure such that the fiber dryer (30) forms a closed housing, in the walls of which the drying air is only allowed to enter and leave at the openings that are necessary for leading the belts (31, 32) as well as the fibers in and out as well as at the air guide ducts of the air circulating system. All other areas of the walls are preferably closed in an air-tight manner. The walls of the fiber dryer (30) are provided, furthermore, with a heat insulation in order to limit a heat loss to the outside.

The air stream (36*a*) within the middle chamber (34) is preferably made uniform and its intensity is controlled by at least one nozzle array (37, 38) at the treatment belt (31) and/or at the filter belt (32). The nozzle array (37) under the treatment belt (31, 31*b*) is formed in the example according to FIG. 1 by air guide plates, which are arranged alternatingly obliquely and which are connected to one another at their lower ends in an air-tight manner. Passage openings are arranged at the upper ends of the air guide plates for the drying air with a predefined and preferably adjustable opening cross section. These opening cross sections form the nozzles, through which the drying air can flow from the lower chamber (33) to the middle chamber (34). The nozzles are preferably distributed flatly under the drying zone section (31*b*). In particular, a plurality of rows of nozzles or slot-like nozzles arranged one after another in the conveying direction (x) may be provided. The opening cross section of the nozzle array (37) is preferably markedly smaller than the cross-sectional area of the lower chamber (33). The lower chamber acts as a result as a buffer, in which an essentially uniform pressure can build up. If nozzles with equal opening cross section are provided within the nozzle section (37), an essentially equally intense volume flow, which flows through the fiber mat (13, 14) arranged on the treatment belt (31, 31*b*), is allowed at these nozzles.

The opening cross sections of the nozzles may be selected to be equal or different along the conveying direction (x) and possibly at right angles thereto. In particular, the opening cross sections may be able to be adjusted locally in order to influence, especially to regulate, the intensity of the air stream (36*a*) along the conveying direction (x).

The above-mentioned nozzle array (37) may act at the same time as a support device for the treatment belt. As an alternative, a separate support device may be provided, on which the treatment belt (31) can be placed and guided in a mechanically supported manner along the conveying direction (x).

An additional nozzle array (38), which may have essentially the same configuration as the above-described nozzle array (37) under the treatment belt, is provided above the filter belt (32) in the example according to FIG. 1. As an alternative, another form of a nozzle array and/or of a support device may be provided at the filter belt (32). Adjustability and especially a local adaptability of the opening cross section of the nozzles may also be provided in case of the nozzle array (38) at or above the filter belt (32) (the lower run of the filter belt (32)).

The fiber dryer (30) may preferably have two or more drying sections (or "sections" for short) (A, B, C, D), through which the treatment belt (31, 31*b*) and the fiber mat (13, 14) can be consecutively moved. A drying air (36) with different moisture levels (F) and/or different temperatures (T) is preferably generated within the sections (A-D). Furthermore, the air stream (36*a*) may be predefined separately within a section (A-A), especially with a higher or lower volume flow. The parameters of the drying air (moisture content (F), temperature (T), volume flow) can preferably be controlled and especially regulated over the course of the conveying direction (x) as a function of the material to be dried.

A curve of the temperature (T) as well as a curve of the moisture content (F) of the drying air along the conveying direction (x) are shown as an example in the upper area of FIG. 1. The drying air (36) is generated such that the moisture content (F) decreases in the conveying direction (x). This can happen especially due to the fact that at least a portion of the drying air is guided from a section©, D) located in the rear in the conveying direction (x) against the conveying direction (x) to a section (A, B) located in the front and is used there once again for drying. In particular, provisions may be made for guiding the drying air from the outlet area of the fiber dryer (30) to the intake area (main guiding path), i.e., in counterflow to the conveying direction (x) of the material to be dried. In addition, inflows of fresh air and/or outflows of used air may be provided, which are superimposed to the portion of the drying air that is guided in counterflow (auxiliary conveying paths).

According to the example in FIG. 1, the temperature (T) of the drying air (36) is described at first by a rising curve in the conveying direction (x) and by a falling curve towards the outlet. This temperature curve represents a preferred embodiment variant. At the intake of the fiber dryer (=end of the main conveying path of the drying air), the drying air is preferably heated only moderately, because it leaves the fiber dryer (30) as used air with maximum moisture content after a relatively short path and a needless heat loss shall be avoided. The evaporation taking place during the drying leads to cooling of the drying air.

It is advantageous to heat the drying air (36) to a reduced extent or to regulate the temperature of the drying air to a relatively low level in the discharge area of the fiber dryer (30) as well. The material to be dried has only a low moisture content at the discharge area (=beginning of the main conveying path of the drying air) of the fiber dryer (30). Most of the heat contained in the drying air will therefore lead to a heating of the fibers rather than to evaporation (only). The lower the moisture content in the fibers, the more sensitively can the fibers respond to overheating. The discharge of excessively heated fibers would also represent a needless heat loss.

By contrast, only half-dry fibers, which show only a relatively low sensitivity to overheating, are present in the middle area of the fiber dryer (30), and a substantial percentage of the heat in the drying air will lead to heating and evaporation of the liquid or moisture being stored in the fiber mat. A markedly more intense heating of the drying air (36) can correspondingly take place in the middle area, and markedly higher temperatures (T) of the drying air are permissible there.

The percentage of fly (16) may rise over the course of the conveying direction (x) and with increasing degree of dryness of the fiber mat (14). This is illustrated in FIG. 1 by the number and density of the lines, which represent the fly (16). Further, the effective surface of the fibers in the material being dried, which surface is available for the drying, may increase because of the loosening along the conveying direction (x) (expansion of the fiber mat). It may therefore be advantageous to vary the volume flow of the air stream (36*a*) generated in the middle chamber (34) along the conveying direction (x), especially to reduce it towards the outlet. This can be brought about in different ways. On the one hand, a different pressure difference can be generated between the lower chamber (33) and the upper chamber (35) within each of the sections (A-D), especially in order to set a basic level of the air stream (36*a*). In particular, a plurality of sections (A-D) or preferably all sections (A-D) may have for this purpose at least one separate air circulating fan (43).

As an alternative or in addition, one section (A-D) may have a separate air outlet (45), at which especially a device for reducing or regulating the air discharge flow may be provided. Likewise as an alternative or in addition, one section (A-D) or each section (A-D) may have a separate fresh air inlet (44). The pressure level generated in the upper chamber (35) and in the lower chamber (33) is always related to the volume flows of the drying air along the main conveying direction and to the volume flows of the fresh air into the fiber dryer (30) or into a section as well as of the used air from the fiber dryer (30) or from a section.

Figure 2:
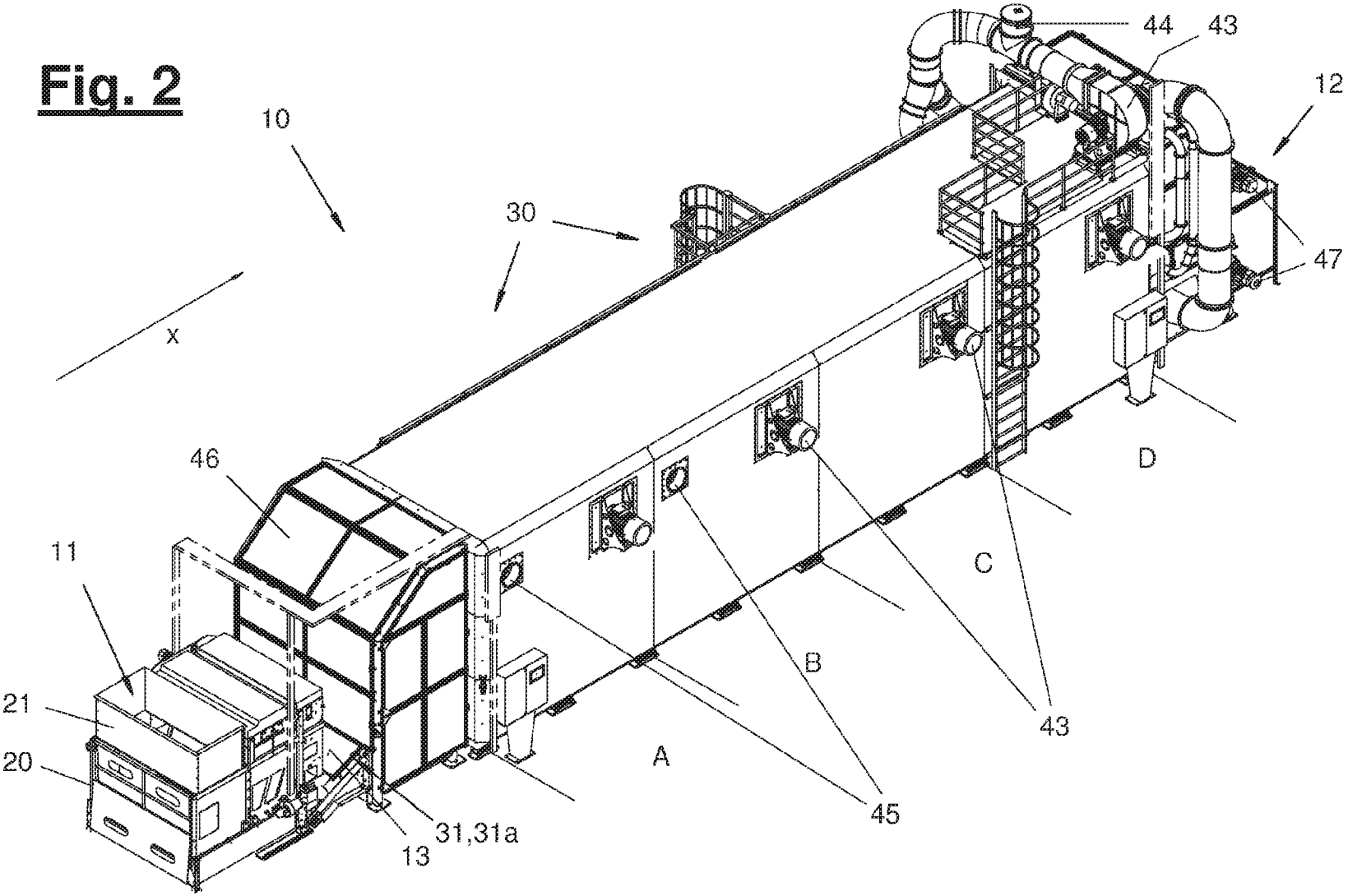
FIG. 2 is an oblique view of the fiber treatment plant from FIG. 1.

Different layouts of the sections (A-D) according to a preferred embodiment variant are shown in the example according to FIG. 2. Each of the sections (A-D) has a separately controllable air circulating fan (43) here, which is arranged in a side wall of the fiber dryer (30). The first and second sections (A and B) in the conveying direction have each an air outlet (45). The following sections© and D) have each an air inlet or fresh air inlet (44).

Figure 3:
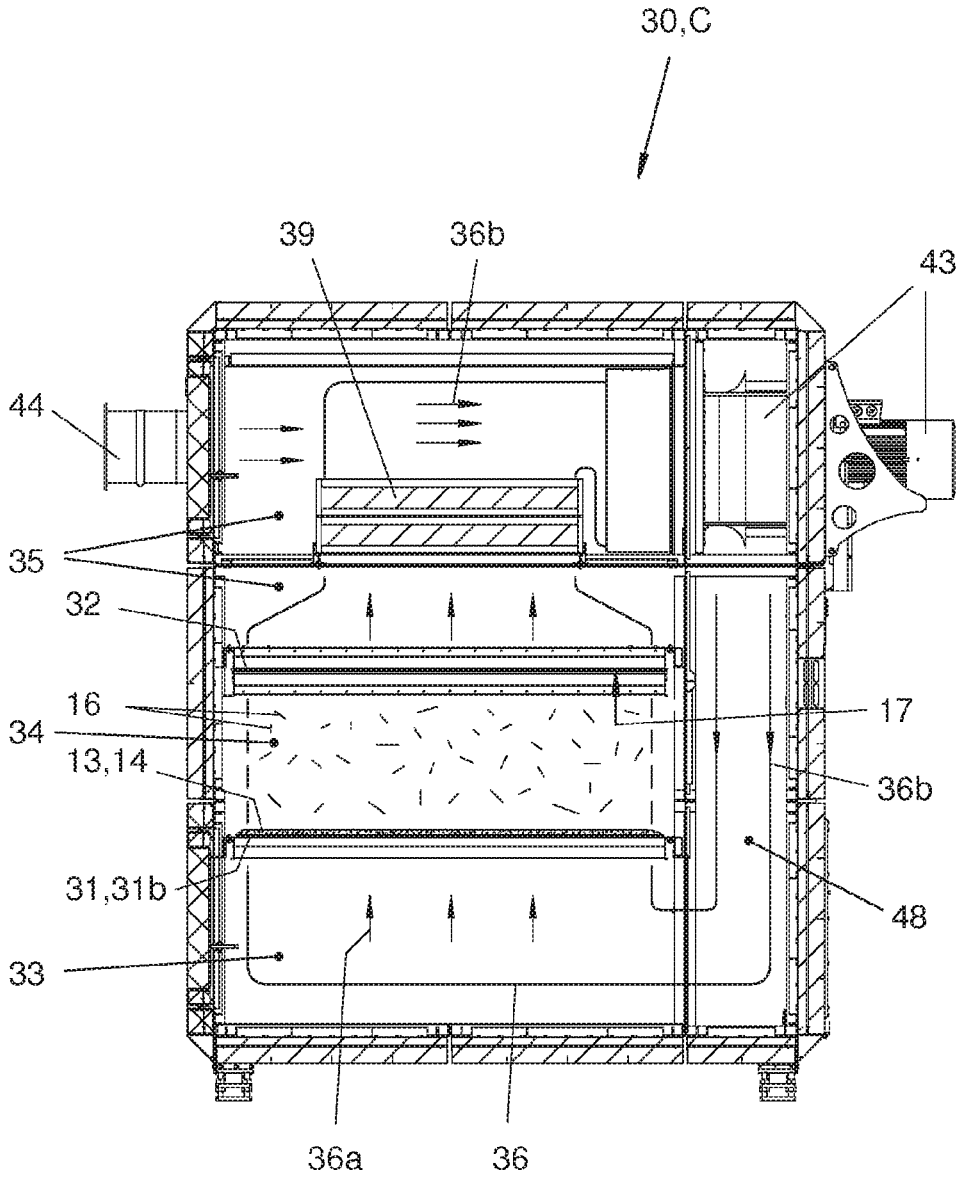
FIG. 3 is a longitudinal sectional view through the fiber treatment plant according to FIG. 1 in the area of the fiber dryer.

FIG. 3 shows as an example a cross section through the section D of the fiber dryer (30) from FIG. 2. The air circulating fan (43) is shown here in the top right area. It is used to draw in air present in the upper chamber (35) and to send it at least downward as a return flow (36*b*) into a return duct (48). The return duct (48) may preferably extend laterally next to the arrangement of the treatment belt (31), of the filter belt (32) and of the middle chamber (34) located between these. It opens on the upper side preferably into a blow-out area of the air circulating fan (43) and in a lower area into a transition to the lower chamber (33). The cross-sectional area of the transition is preferably markedly larger than the cross-sectional area of the nozzles in the nozzle section (37).

A relative overpressure is generated in the lower chamber (33) by the air circulating fan (43) and the return flow (36*b*). The pressure difference between the upper chamber (35) and the lower chamber (33) can be influenced by a control or regulation of the conveying capacity of the air circulating fan (43) and it can possibly be set to a desired pressure difference. Furthermore, the pressure in the upper chamber (35) can be influenced by regulating the air stream, which is fed through the fresh air inlet (44), for example, by actuating a throttle valve.

At least a portion of the air blown off by the air circulating fan (43) can be sent essentially against the conveying direction (x) to an adjacent section (B) and/or to an air outlet (45). In particular, a connection duct (not shown),which opens into an upper or lower chamber (33, 35) in an adjacent section (B), may be connected at a blow-out area of the air circulating fan (43).

The person skilled in the art will recognize that the pressure can be controlled in each section (A-D) and there both in the upper chamber (35) and in the lower chamber (33) and preferably regulated to a desired pressure by the control of the outputs of the individual air circulating fans (43) and by reducing the different air streams (fresh air intake, passage flow to the adjacent section, waste air flow). One or more pressure sensors may be arranged in the respective chambers (33, 35) in order to detect an actual pressure and to send it to a pressure regulator.

The intensity of the air flow (36*a*) can be controlled and especially regulated by presetting the respective pressures in the lower chamber (33) and/or in the upper chamber (35). Moreover, influencing by adapting the flow cross sections in the area of the nozzle sections (37, 38) is possible, especially in order to change a local intensity of the air stream (36*a*) within a section (A, B, C, D) and preferably along the conveying direction (x) relative to the basic level, which is preset by the pressure difference between the lower chamber (33) and the upper chamber (35).

The drying air (36) may be heated at any desired point within or outside the fiber dryer (30). The heating is preferably achieved by means of an internal heat exchanger (39), especially a steam heat exchanger. As an alternative or in addition, any other desired heating device may be provided.

The heat exchanger (39) is arranged in the upper chamber (35) in the example shown in FIGS. 1 and 3. As an alternative, it could be arranged in the lower chamber (33) or in the return duct (48). The arrangement in the upper chamber (35) has the advantage that a percentage of the drying air fed from the fresh air inlet (44) is sent through the heat exchanger (39) or along the heat exchanger (39) and is heated directly after entry into the fiber dryer (30).

The deposit formed by fly on the filter belt (32) can be separated from the filter belt (32) in any desired manner and at any desired point. FIG. 1 shows a preferred embodiment variant for separating the deposit. (At least) one stripping blower (40) is provided, which is configured to separate the deposit from the filter belt by a downwardly directed air stream. Such a stripping blower (40) may preferably be arranged, according to the view shown in FIG. 1, at the outlet, i.e., behind the last section (D) of the fiber dryer (30) in the conveying direction (x). It may have any desired configuration, for example, in the manner of an air blade.

Furthermore, a return shaft (41) may be provided, through which fibers that are separated from the filter belt (32) are returned to the dried fiber mat (15). Such a return shaft (41) may be arranged especially corresponding to a stripping blower (40) such that the air stream generated by the stripping blower (40) blows the separated fibers into the return shaft (41). The return shaft (41) preferably extends between the filter belt (32) and the treatment belt (31) and especially in the vertical direction. The vertical extension of the return shaft (41) may be flush with the extension of a middle chamber (34). As an alternative to the example according to FIG. 1, a stripping blower and a return shaft (41) may also be provided within the fiber dryer (30). In particular, one or more of the sections (A-D) may have a return shaft (41) of its own and possibly a stripping blower (40) of its own, which may be arranged especially in the area of the discharge of the respective section (A-D).

The dry fiber mat (15) may be released or taken off in any desired manner in the area of the dry fiber outlet (12). In the example according to FIG. 1, a deflection is provided for the treatment belt (31), by which the treatment belt (31) is led at least partially into a path extending opposite the conveying direction (x). The deflection is preferably configured to separate the dried fiber mat (15) from the treatment belt (31, 31*c*), especially by throwing off the fiber mat. Two guide plates are arranged obliquely under the deflection in the example according to FIG. 1. The upper guide plate is brought close to the returned treatment belt (31), so that the dry fiber mat (15) falling off from the discharge section (31*c*) can slide onto the upper guide plate.

It may happen that residual fibers remain at the treatment belt behind the deflection after the throwing off or in the motion direction of the (circulatingly guided) treatment belt (31). Such residual fibers are preferably separated from the treatment belt (31) and fed to the rest of the fibers in the dry fiber mat (15). This may be carried out in any desired manner.

An additional stripping blower (42), which is configured to separate the residual fibers from the treatment belt (31), is provided next to the deflection in the example according to FIG. 1. The additional stripping blower (42) generates an air stream, which is oriented essentially in the conveying direction (x) and which is directed (in an area behind the deflection and after the throw-off of the dry fiber mat) through the air-permeable treatment belt (31). The air stream of the additional stripping blower preferably blows the residual fibers into an area between the guide plates, so that these fibers are guided in the direction of the dry fiber mat being guided on the upper guide plate. As an alternative, the stripping blower may blow off the residual fibers in another direction, for example, downwards, where, for example, a collection vat or an additional removing belt may be arranged.

The fiber treatment plant (10) may have various sensors and controls in order to influence or to regulate the drying process. A regulation of the degree of drying of the fibers in the material being dried is especially preferably provided (adaptation of a determined actual moisture level to a desired moisture level). A device (49) for determining the moisture in the fiber mat (15) may be provided for this purpose at least at the outlet of the fiber dryer (30). The conveying motion of the treatment belt (31) and/or the properties of the air stream (36*a*) may preferably be controlled as a function of the moisture content determined. In addition, one or more additional devices for determining the moisture content in the fiber mat may be provided, which are arranged at the intake area or within the fiber dryer (30). The control of the conveying motion of the treatment belt (31) and/or the properties of the air stream (36*a*) can be carried out correspondingly as a function of detected differences in the moisture content. A moisture detection device may be arranged especially at the intake to at least one section (A, B, C, D), and the properties of the air stream (36*a*) (temperature, moisture content and intensity of the drying air stream) can be regulated in at least this section according to a difference between a desired moisture content and the moisture content determined at the intake. The desired moisture content may be, for example, a moisture content in the fiber mat (14), which shall be reached at the discharge of the respective section (A-D) or at the intake of a next section.

Various modifications of the present invention are possible. In particular, the features described, shown, claimed or otherwise disclosed in connection with the exemplary embodiments may be combined with one another, mutually replaced with one another or omitted.

Various measures may be taken at the fiber treatment plant (10) for avoiding an undesired fiber discharge or the entry of contaminants. The intake area and the discharge area of the fiber dryer (30) may preferably have an additional housing (46), which covers especially the fiber belt (32) and possibly large parts of the treatment belt (31). One or more cleaning devices, which free the filter belt (32) from residual fibers or contaminants before its entry into the first section (A) of the fiber dryer (30) and/or the treatment belt (31) prior to the placement of the wet fiber mat (13), may be present.

Any other desired number of drying sections may be provided instead of the four sections (A-D) provided in the figures.

The components of the fiber treatment plant (10) that come into contact with the fibers and with the drying air preferably have a corrosion-resistant configuration and, depending on the type of the material to be dried, a solvent-resistant configuration. The filter belt (32) may preferably be a belt made of stainless special steel, especially a perforated belt, a woven belt or a mesh belt. A treatment belt (31) made of PPS proved to be advantageous during the drying the viscose fibers.

Instead of a fiber mat, one or more fiber strands may be formed on the treatment belt (31). The length of a fiber to be dried maybe, for example, in the range of 5 mm to several cm. A fiber length of 10 mm to 50 mm may be advantageous for the drying in the case of viscose fibers. An equalizing spraying, by which an opposite air stream directed from top to bottom is directed onto the fiber mat to be dried, may optionally be provided within the middle chamber (34). The intensity of the opposite air stream is preferably far lower than the intensity of the air stream (36*a*) directed from bottom to top. The equalizing spraying may be brought about by any desired device, for example, by a pipe, which extends over the width of the treatment belt and is located at an upwardly spaced location in relation to the treatment belt, and which has nozzle openings arranged on its underside and to which an air stream is admitted.

The feed section (31*a*), the drying zone section (31*b*) and the discharge section (31*c*) of the treatment belt (31) shown in the figures may be formed by a single treatment belt (31) or, as an alternative, by separate belts, between which the fiber mat is transferred. However, all the above-mentioned functional sections are preferably parts of a single treatment belt (31), which extends through the entire fiber dryer (30) as a circulating belt.

The treatment belt (31) and the filter belt (32) may be driven in any desired manner. According to the example in FIGS. 1 and 2, a belt drive (47) is provided at the respective last deflecting roller of the treatment belt (31) and of the filter belt (32) in the conveying direction (x). It is ensured by this form of drive that the belt drive (47) supports the tightening of the upper run of the treatment belt (31) and of the lower run of the filter belt (32) in the fiber-carrying areas (within the at least one middle chamber). An undesired sagging of the belts (31, 32) is thus counteracted.

Locks may be provided at an intake area of the treatment belt and/or of the fiber belt to a middle chamber and at a discharge area of the treatment belt and/or of the fiber belt from a middle chamber in order to reduce a temporary air stream tangentially to the respective belt. Such locks may be formed, for example, by films that are elastically in contact. A (local) adhesion of fibers to the respective belt and/or at the lock may optionally be influenced, especially increased, by electrostatic fields.

The term "air" (drying air, fresh air, used air) is defined in the sense of the present invention as "gaseous drying agent." It may preferably be breathing air from the atmosphere, to which additional gases or vapors may possibly be added. As an alternative, it may be another (pure) gas or a gas composition.

One or more additives, which react within the fiber dryer with the fibers being dried, for example, in order to impregnate or to coat these, may be added to the drying air.

While specific embodiments of the invention have been shown and described in detail to illustrate the application of the principles of the invention, it will be understood that the invention may be embodied otherwise without departing from such principles.

The invention claimed is:

1. A drying process for drying damp or wet fibers, the drying process comprising:

forming a fiber mat from wet or damp fibers on a treatment belt, which is moved in a conveying direction through a fiber dryer, which is essentially air-tight towards an outside;

of generating an air stream in the fiber dryer from a heated drying air, wherein the air stream is sent in an upward direction through a flat drying zone section of the treatment belt and the air stream loosens and dries the fibers contained in the fiber mat; and capturing fly fibers moved by fly fiber movement in the air stream with a filter belt, which filter belt is arranged above the treatment belt and which filter belt is moved in the conveying direction;

wherein a deposit of fibers formed on the filter belt is separated from the filter belt at an outlet of the fiber dryer, with the separated fibers being returned to the dried fibers on the treatment belt.

2. The drying process in accordance with claim 1, wherein the air stream is generated by a pressure difference between a lower chamber, which extends under the drying zone section of the treatment belt, and an upper chamber, which extends above the filter belt.

3. The drying process in accordance with claim 1, wherein a middle chamber is formed between the drying zone section of the treatment belt and the filter belt and wherein the air stream is made uniform within the middle chamber by at least one nozzle array at the treatment belt and/or at the filter belt.

4. The drying process in accordance with claim 1, wherein the fiber mat is moved consecutively through two or more sections of the fiber dryer, in which the two or more sections the air stream with different moisture levels and/or with different temperatures is present.

5. The drying process in accordance with claim 1, wherein a moisture level in the drying air, which decreases in the conveying direction, is generated.

6. The drying process in accordance with claim 1, wherein a rising temperature curve of the drying air is first generated in the conveying direction and a temperature curve of the drying air falling towards an outlet is generated.

7. A fiber treatment plant for drying damp or wet textile fibers, the fiber treatment plant comprising a fiber dryer, which is essentially air-tight to an outside, the fiber dryer comprising:

an air-permeable treatment belt, which can be moved in a conveying direction through the fiber dryer;

a filter belt, which is arranged above the treatment belt and can be moved in the conveying direction;

a middle chamber, which is formed between a drying zone section of the treatment belt and the filter belt, and an air circulating system, which is configured to form an air stream from a heated drying air, which flows in an upward direction through the middle chamber and a fiber mat, which can be laid on the treatment belt, so that the fibers in the fiber mat, are loosened and dried;

wherein the fiber dryer has a return shaft, through which the fibers, which are separated from the filter belt, can be returned to the dried fiber mat.

8. The fiber treatment plant in accordance with claim 7, wherein the fiber dryer has a cleaning device for the filter belt.

9. The fiber treatment plant in accordance with claim 7, wherein the fiber dryer has a stripping blower, which is configured to separate a deposit, which is formed from fibers moved by the air stream, from the filter belt.

10. The fiber treatment plant in accordance with claim 7, wherein the return shaft is arranged behind the middle chamber in the conveying direction and between the filter belt and the treatment belt.

11. The fiber treatment plant in accordance with claim 7, wherein at least one lower chamber is formed under the drying zone section of the treatment belt and at least one upper chamber is formed above the filter belt, and a pressure difference is generated between said at least one lower and at least one upper chambers by the air circulating system.

12. The fiber treatment plant in accordance with claim 11, further comprising a nozzle array, by which an air stream from the at least one lower chamber to the middle chamber is made uniform, is formed under the treatment belt.

13. The fiber treatment plant in accordance with claim 11, wherein a nozzle array, by which an air stream from the middle chamber to the at least one upper chambers is made uniform, is formed at or above the filter belt.

14. The fiber treatment plant in accordance with claim 7, wherein the fiber dryer has two or more drying sections, between which the two or more drying sections an air stream is formed.

15. The fiber treatment plant in accordance with claim 14, wherein the air circulating system is configured to convey at least a part of the heated drying air against the conveying direction from a rear drying section to a drying section located farther in a front of the fiber dryer.

16. The fiber treatment plant in accordance with claim 7, further comprising a device for determining a moisture content in the fiber mat provided at least at an outlet of the fiber dryer, and wherein a conveying motion of the treatment belt and/or properties of the air stream are controlled as a function of the determined moisture content.

17. The fiber treatment plant in accordance with claim 7, wherein the fiber dryer further comprises a stripping blower in an area of a dry fiber outlet, the stripping blower being configured to separate other residual fibers from the treatment belt after a separation of the dried fiber mat from the treatment belt.

18. The fiber treatment plant in accordance with claim 7, further comprising a fiber mat producer arranged upstream of the fiber dryer, wherein the fiber mat producer is configured as a feed shaft, vibrating shaft or as a hopper feeder.

* * * * *